US009869951B2

(12) United States Patent
Okamoto

(10) Patent No.: US 9,869,951 B2
(45) Date of Patent: Jan. 16, 2018

(54) BELT ROTATING DEVICE, TRANSFER DEVICE, AND IMAGE FORMING APPARATUS

(71) Applicant: Sharp Kabushiki Kaisha, Osaka (JP)

(72) Inventor: Shohtaro Okamoto, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 15/276,969

(22) Filed: Sep. 27, 2016

(65) Prior Publication Data

US 2017/0090356 A1 Mar. 30, 2017

(30) Foreign Application Priority Data

Sep. 30, 2015 (JP) ..... 2015-194876

(51) Int. Cl.
*G03G 15/00* (2006.01)
*G03G 15/16* (2006.01)

(52) U.S. Cl.
CPC ..... *G03G 15/1615* (2013.01); *G03G 2215/00143* (2013.01); *G03G 2215/00156* (2013.01); *G03G 2215/0132* (2013.01)

(58) Field of Classification Search
CPC ..... G03G 15/1615; G03G 15/754; G03G 15/755; G03G 2215/00143; G03G 2215/00156; G03G 2215/0132; B41J 11/007
USPC ..... 399/165, 302, 303, 313; 198/806, 807, 198/810.03
See application file for complete search history.

(56) References Cited

U.S. PATENT DOCUMENTS 7,921,987 B2 * 4/2011 Kitamura ..... B41J 11/007 198/806
9,238,552 B2 * 1/2016 Hozumi ..... G03G 15/1615
9,561,912 B2 * 2/2017 Hozumi ..... G03G 15/1615
2014/0008184 A1 1/2014 Hozumi et al.

FOREIGN PATENT DOCUMENTS

JP 2014-10429 A 1/2014

* cited by examiner

*Primary Examiner* — Sophia S Chen
(74) *Attorney, Agent, or Firm* — Renner Otto Boisselle & Sklar, LLP

(57) ABSTRACT

A belt rotating device includes: a meandering correction roller that is rotatably supported within a support frame and is one of a plurality of rollers that stretch an endless belt; a supporting portion that is provided at the support frame and supports a rotating shaft of the meandering correction roller so as to be able to incline the rotating shaft of the meandering correction roller in a one direction; a collar member that is provided on the rotating shaft of the meandering correction roller, contacts the side end of the endless belt in which meandering has occurred, and moves in an axial direction; and an inclination guide portion that is supported by the support frame and has an inclined surface downward and inclined with respect to the shaft of the meandering correction roller, in a position in which the contact portion of the collar member contacts the inclination guide portion.

8 Claims, 6 Drawing Sheets

BELT ROTATING DEVICE, TRANSFER DEVICE, AND IMAGE FORMING APPARATUS

CROSS REFERENCE

This Nonprovisional application claims priority under 35 U.S.C. §119(a) on Patent Application No. 2015-194876 filed in Japan on Sep. 30, 2015, the entire contents of which are hereby incorporated by reference.

BACKGROUND OF THE INVENTION

The present invention relates to a device of rotating an endless belt, a transfer device that corrects the meandering of a transfer belt, for example, and an image forming apparatus provided with such a transfer device.

Conventionally, an image forming apparatus that transfers a toner image on a recording paper sheet through a transfer belt has been proposed (see Japanese Unexamined Patent Application Publication No. 2014-10429, for example). The transfer belt is stretched over a plurality of rollers arranged side by side, performs a rotating movement with rotation of the rollers, and transfers a toner image by this rotating movement. However, if a shift occurs in parallelism among the rollers due to a change with the passage of time of the rollers, each member that rotatably supports the rollers, or the like, the transfer belt may shift accordingly, that is, may meander in the axial (thrust) direction of the rollers, which may thus cause breakage of the transfer belt or deterioration of image quality. Japanese Unexamined Patent Application Publication No. 2014-10429 discloses a meandering correction technique for returning the meandering transfer belt to the original position. In other words, a meandering correction technique includes: a belt butt portion that is provided in the end portion in the axial direction of a roller and moves in the axial direction in response to the press of the side end of a meandering transfer belt, a shaft displacement portion that has an inclined surface and moves in the axial direction according to the movement of the belt butt portion, a shaft guide portion that is fixedly arranged radially outwardly as opposed to the inclined surface, and a configuration in which the shaft of the roller is inclined in the opposite direction by the reaction force received from the contact of the inclined surface of the shaft displacement portion and the shaft guide portion. According to this configuration, when the transfer belt meanders, the inclined surface changes a position of contact with the shaft guide portion, that is, the shaft of the roller is inclined, and, as a result, the meandering is corrected in response to the force with which the transfer belt returns in a direction opposite to the meandering direction.

However, the meandering correction technique disclosed in Japanese Unexamined Patent Application Publication No. 2014-10429 has the following problems. A description is given below using FIG. 6B that simply illustrates a configuration disclosed in Japanese Unexamined Patent Application Publication No. 2014-10429. On the assumption that the meandering to the left has occurred in a transfer belt 202 that rotates by rotation of a roller 201, a shaft displacement portion 203 moves to the left, a inclined surface 204 contacts a shaft guide portion 205, and the roller 201 inclines the shaft downward in the radial direction in response to the reaction force. Therefore, a position in which the shaft guide portion 205 and the inclined surface 204 contact is displaced in the radial direction of the shaft of the roller 201. For example, in the state in which a meandering quantity is small, as illustrated in FIG. 6B, a reaction force F1 occurs in a position P1 near the shaft of the roller 201, and the roller 201 receives a load in the direction of the reaction force F1. On the other hand, in the state in which the meandering quantity is large, although not illustrated in FIG. 6B, the shaft of the roller 201 is, in practice, made to be inclined more downward, accordingly, a reaction force F2 occurs in a position P2 farther away from the shaft of the roller 201, and the roller 201 receives a load in the direction of the reaction force F2. In this manner, since the roller 201 is different in the direction that receives a load according to the magnitude of the meandering quantity, smooth rotation may be damaged under a meandering state.

In view of the problems described above, various preferred embodiments of the present invention are directed to provide a belt rotating device, a transfer device, and an image forming apparatus that stabilize the rotating operation of a meandering correction roller by keeping the direction of a load constant, the load being applied to the meandering correction roller when the rotating shaft is inclined regardless of the magnitude of the meandering quantity of an endless belt.

SUMMARY OF THE INVENTION

A belt rotating device according to a preferred embodiment of the present invention includes: a meandering correction roller that is rotatably supported within a support frame and is one of a plurality of rollers that stretch an endless belt; a supporting portion that is provided at the support frame and supports a rotating shaft of the meandering correction roller so as to be able to be inclined in a one direction; a collar member that is provided on the rotating shaft of the meandering correction roller, contacts an end of the endless belt in which meandering has occurred, and moves in an axial direction; and a contact member that is supported by the support frame and has an inclined surface oriented in the one direction and inclined with respect to the rotating shaft, in a position in which a portion of the collar member contacts the contact member.

The foregoing and other features and attendant advantages of the present invention will become more apparent from the reading of the following detailed description of the preferred embodiments with reference to the attached drawings.

DETAILED DESCRIPTION OF THE EMBODIMENTS

Figure 1:
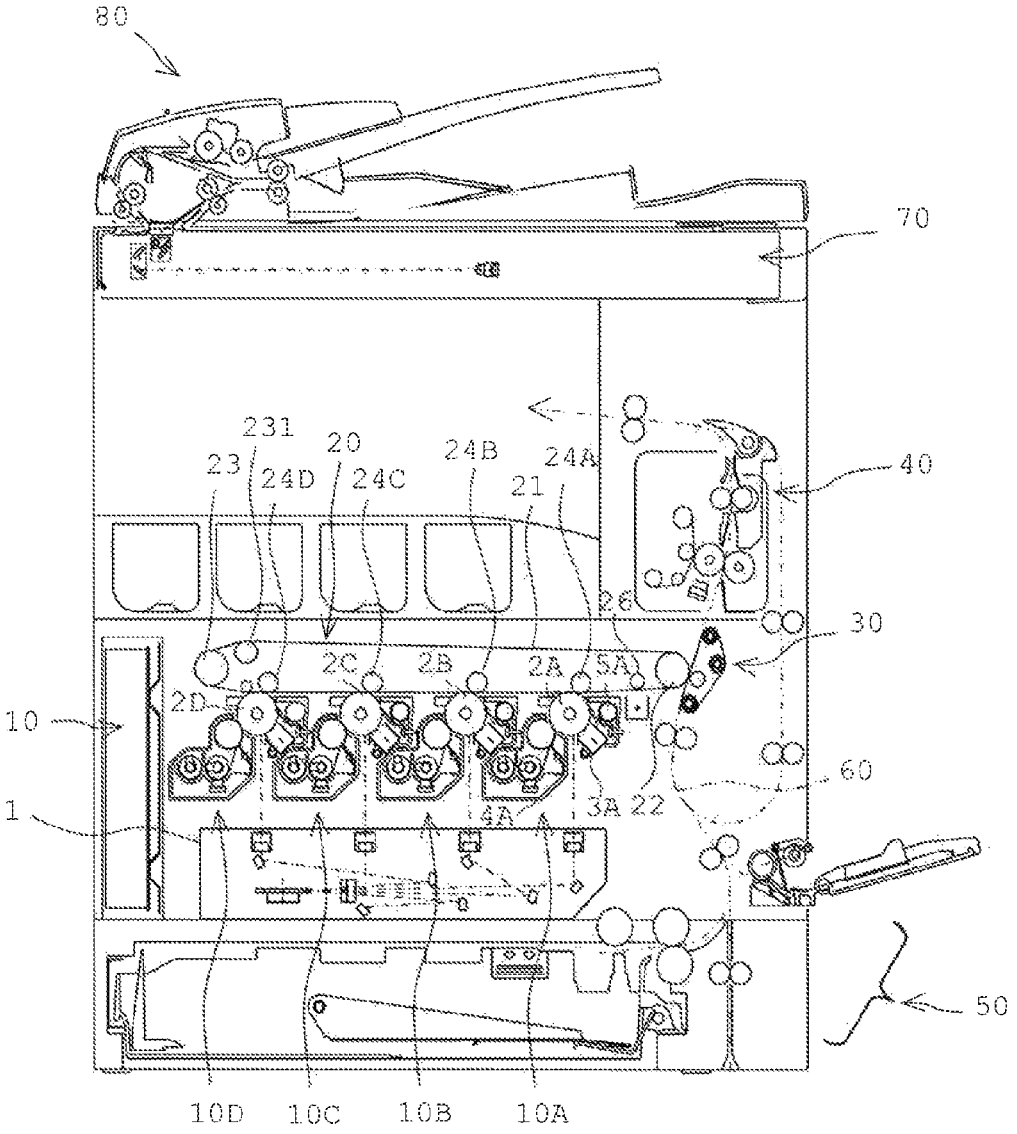
FIG. 1 is a sectional side elevational view illustrating a schematic configuration of an image forming apparatus according to the present invention.

As illustrated in FIG. 1, an image forming apparatus includes a main body housing provided with an image forming portion 10, an intermediate transfer portion 20, a secondary transfer portion 30, a fixing portion 40, a paper feed portion 50, a paper sheet feed path 60, a reading portion 70 that reads a document image, and an automatic document feeder 80. The image forming apparatus prints image on a recording paper sheet data read from a document and image data received from a non-illustrated information processing device.

The image forming portion 10 includes a laser scanning unit 1 and image forming portions 10A to 10D each of which has a similar structure. The laser scanning unit 1 has a housing in which optical components such as a laser element and a polygon mirror for laser scanning for each color are arranged inside. The laser scanning unit 1 scans by exposures the surfaces of photoreceptor drums 2A to 2D of the image forming portions 10A to 10D in an axial direction (primary scanning direction) with laser light modulated corresponding to the image data of each color after conversion, and forms an electrostatic latent image of each color. The image forming portion 10A as a representative example of the image forming portions 10A to 10D is provided with the photoreceptor drum 2A and includes a charging device 3A, a developing device 4A, and a cleaning portion 5A around the photoreceptor drum 2A in the rotational direction (secondary scanning direction) of the photoreceptor drum 2A.

The intermediate transfer portion 20 is provided with an intermediate transfer belt 21, a driving roller 22, a meandering correction roller 23, and primary transfer rollers 24A to 24D, and primarily transfers toner images formed on the peripheral surfaces of the photoreceptor drums 2A to 2D on the surface of the intermediate transfer belt 21. The secondary transfer portion 30 secondarily transfers the toner image on the surface of the intermediate transfer belt 21 onto a recording paper sheet. The fixing portion 40 heats and fixes the toner image transferred onto the recording paper sheet and outputs the toner image to a paper output tray. The paper feed portion 50 includes a paper feed cassette or a manual feed tray and feeds a selected recording paper sheet from a corresponding paper feed cassette to the paper sheet feed path 60.

Figure 2:
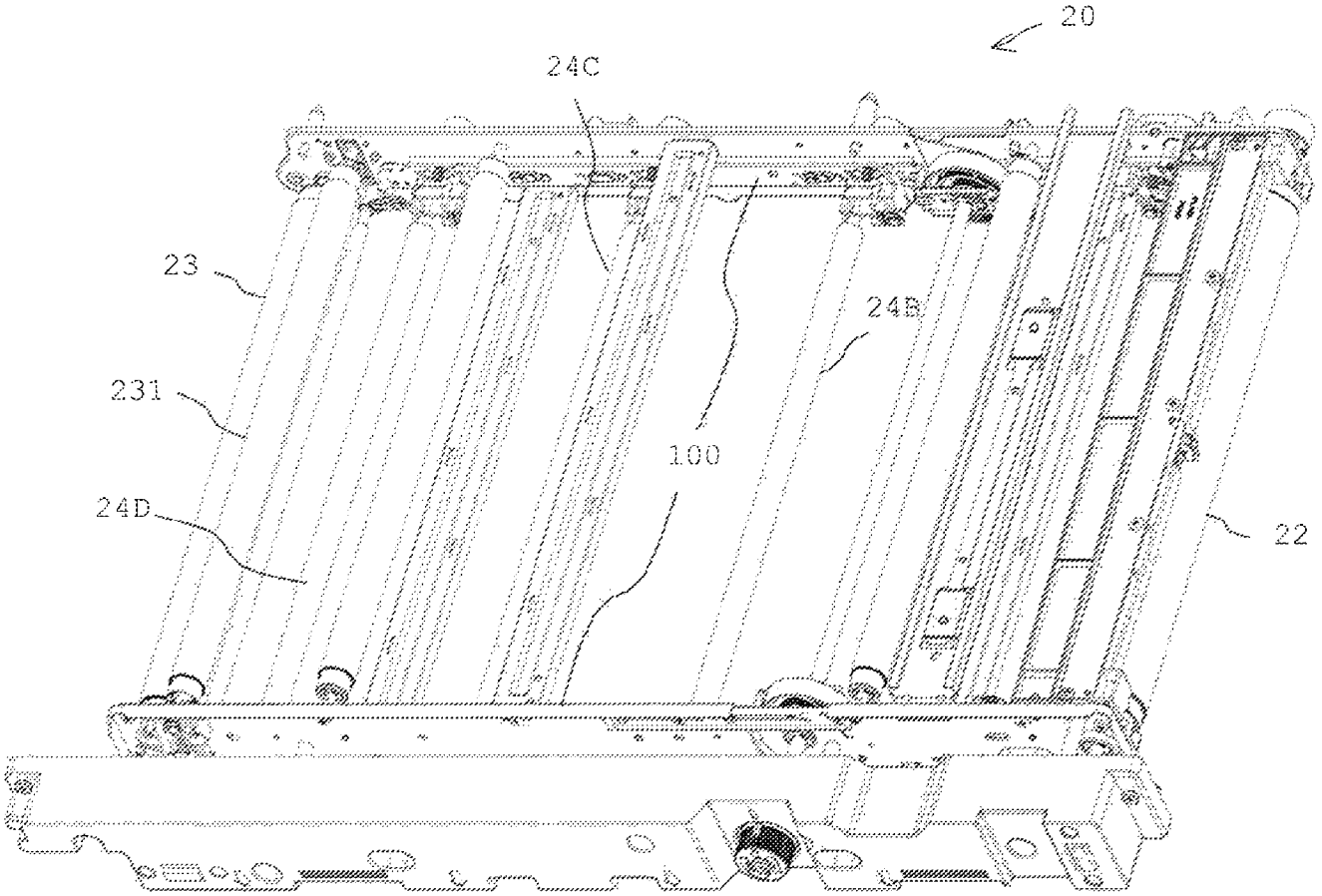
FIG. 2 is a reference perspective view to understand an arrangement of members inside an intermediate transfer portion in which a transfer belt is omitted.

In FIG. 2, the intermediate transfer portion 20 is supported by a support frame 100 installed to face each other in the width direction of the intermediate transfer belt 21. Specifically, the driving roller 22 and the meandering correction roller 23 in parallel to each other on both right and left sides, and further the primary transfer rollers 24B, 24C, and 24D (24A is not visible) of each color between the driving roller 22 and the meandering correction roller 23 are each pivotally supported at the both ends of the rollers in the axial direction by the support frame 100. A tension roller 231 is arranged in the vicinity of the meandering correction roller 23. The intermediate transfer belt 21, on the left end side, is stretched around the meandering correction roller 23 and the tension roller 231, which applies a predetermined tension to the intermediate transfer belt 21. As another mode, the meandering correction roller 23 is also able to be configured to work as a tension roller.

Figure 3:
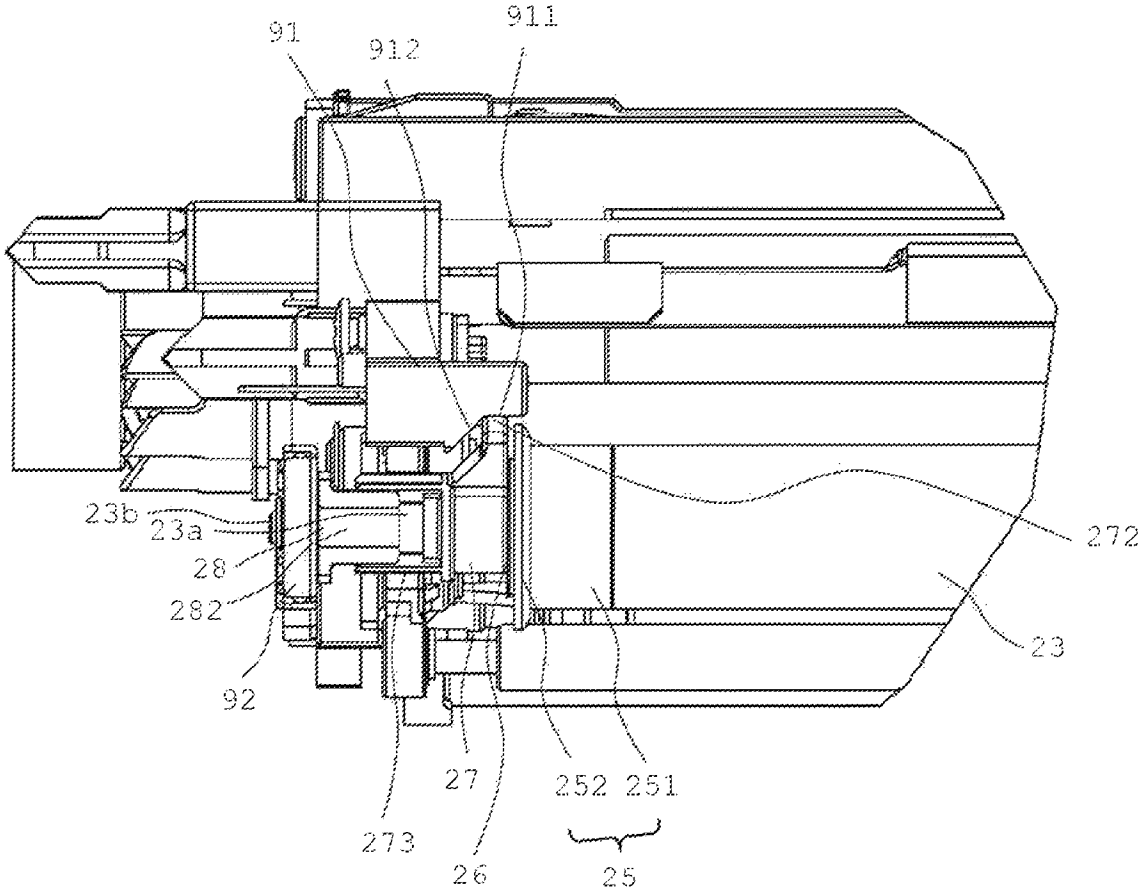
FIG. 3 is a partially enlarged front view of an end portion of a meandering correction roller to illustrate a meandering correction mechanism.
Figure 4:
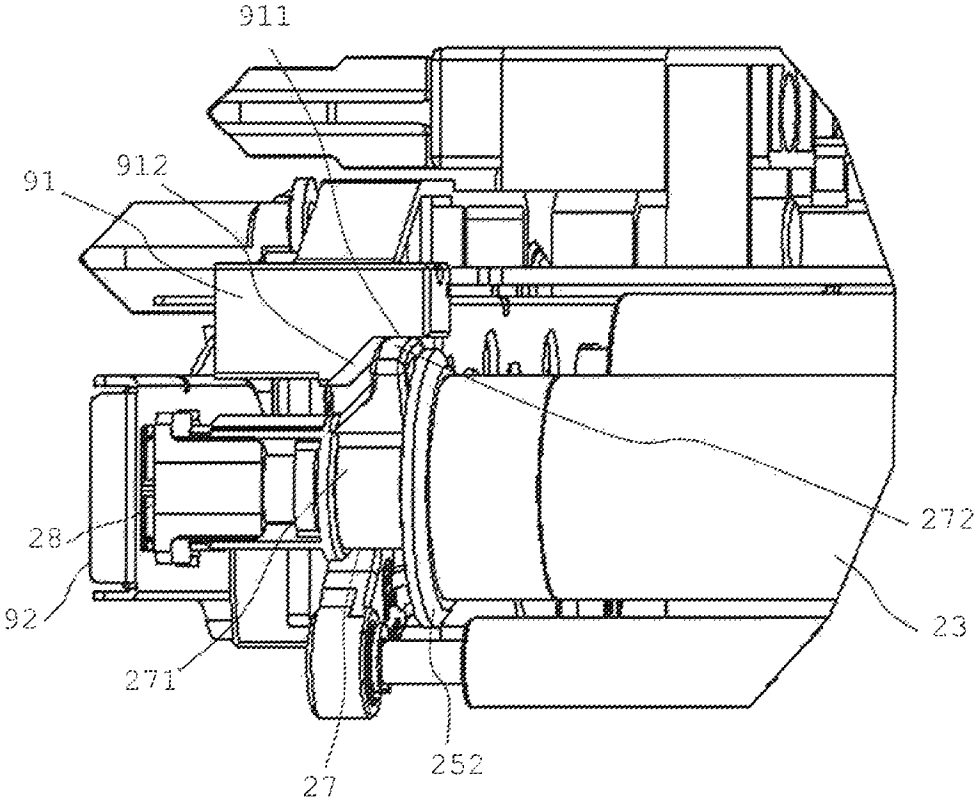
FIG. 4 is a view of a portion of a part corresponding to FIG. 3 as viewed from the oblique front.

It is to be noted that, although FIG. 2 is a reference drawing and does not illustrate a meandering correction mechanism in the end portion of the meandering correction roller 23, the meandering correction mechanism according to a preferred embodiment of the present invention, as illustrated in and after FIG. 3, is arranged in the end portion of the meandering correction roller 23 and the support frame 100.

Figure 6A:
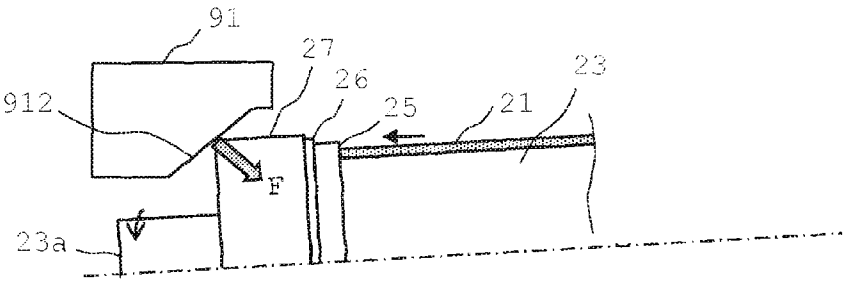
FIG. 6A is a simplified configuration diagram to illustrate a meandering correction movement and is a view illustrating the movement in the present invention.
Figure 6B:
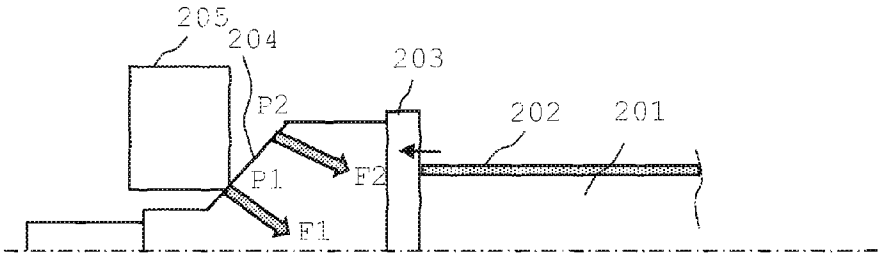
FIG. 6B Prior Art
FIG. 6B is a simplified configuration diagram to illustrate a meandering correction movement and is a view illustrating the movement in conventional techniques.

To begin with, a description is given of a meandering correction mechanism and the function of meandering correction, referring to the simplified configuration diagram illustrated in FIG. 6A. The meandering correction mechanism is provided with an meandering correction roller 23 of which the peripheral surface is stretched around by the intermediate transfer belt 21, a tension collar member 25 that is coaxially attached to the end portion in the axial direction of the meandering correction roller 23, a meandering correction collar member 27 that contacts the tension collar member 25 and moves in the axial direction, a slide sheet 26 that is made of a low friction member inserted between the tension collar member 25 and the meandering correction collar member 27, and an inclination guide portion 91 that is supported by the support frame 100 and provided with an inclined surface 912 that contacts the meandering correction collar member 27. It is to be noted that the tension collar member 25 is fitted to the outside of a shaft 23*a* so as to be capable of rotating and moving in the axial direction movement whereas the meandering correction collar member 27 is fitted to the outside of the shaft 23*a* so as to be capable of only moving in the axial direction movement. In addition, although not illustrated in FIG. 6A, the shaft 23*a* of the meandering correction roller 23 is pivotally supported so as to be able to move (be inclined) in the vertical direction in FIG. 6A.

In the structure, on the assumption that the meandering to the left has occurred in the transfer belt 21 that rotates by rotation of the meandering correction roller 23, the side end of the meandering intermediate transfer belt 21 presses the tension collar member 25, and the tension collar member 25 moves to the left in response to this pressing force, and the meandering correction collar member 27 also moves to the left. Then, the upper left portion of the meandering correction collar member 27 contacts the inclined surface 912 of the inclination guide portion 91, and then the meandering correction roller 23 inclines the shaft 23*a* downward in the radial direction in response to the reaction force F. FIG. 6A illustrates the state in which the shaft 23*a* is inclined. Then, as shown in FIG. 6A, while being displaced on the side of the inclined surface 912, the position of contact is constant on the side of the meandering correction collar member 27. Accordingly, regardless of the magnitude of meandering quantity, the shaft 23*a* of the meandering correction roller 23 always receives as a load the reaction force F from the same direction and thus smooth rotation is maintained even under the meandering state.

Subsequently, a preferred embodiment of the meandering correction mechanism will be more specifically described using FIG. 3, FIG. 5A, FIG. 5B, and FIG. 5C that illustrate the state in which the intermediate transfer belt 21 is omitted. The tension collar member 25, the slide sheet 26, the meandering correction collar member 27, and the bearing portion 28 are fitted to the outside of the shaft 23*a* from the end side of the meandering correction roller 23. The bearing portion 28 is supported by a bearing support portion 92 supported by the support frame 100.

The tension collar member 25 is provided with an annular portion 251 that has the same diameter as the meandering correction roller 23 and has a predetermined length in the axial direction, and a collar portion 252 at the outside end portion of the annular portion 251, and is fitted to the outside of the shaft 23*a*. While integrally rotating with the shaft 23*a*, the tension collar member 25 is configured to be movable in the axial direction. The collar portion 252 receives the contact of the side end of the meandering intermediate transfer belt 21.

The meandering correction collar member 27 is arranged outside of the tension collar member 25 across the slide sheet 26. The meandering correction collar member 27 is configured to spin around with respect to the shaft 23*a* and also to be movable in the axial direction. The meandering correction collar member 27 is provided with an annular portion 271 and a contact portion 272 that is protruded from a portion in the circumferential direction of the annular portion 271 to the radial direction, and is further provided with an engaged portion 273 regulating rotation that extends by a predetermined dimension from the portion in the circumferential direction of the annular portion 271 to the axial direction. The engaged portion 273, as will be described later, is engaged with an engaging portion 282 of the bearing portion 28 in the circumferential direction. In the present preferred embodiment, the engaged portion 273 has the shape of two circular arcs that face each other and are arranged alternately at positions dividing the circumference into quarters in the circumferential direction, for example.

The bearing portion 28 is provided with a flat plate-like base portion 281, and the arc-shaped engaging portion 282 that is installed in a standing manner by the predetermined dimension in the axial direction from the plate-like base portion 281. The plate-like base portion 281 is provided with a shaft hole 281*a* into which the shaft 23*a* is fitted in the center. The engaging portion 282 has the shape of circular arcs that are arranged alternately at positions dividing the circumference of the shaft hole 281*a* of the plate-like base portion 281 into quarters and are installed in a standing manner, facing each other. Accordingly, the engaged portion 273 is engaged with the engaging portion 282 in the circumferential direction in a space in which the engaging portion 282 is not arranged and is movable in the axial direction. It is to be noted that various modes are able to be employed as a configuration in which integrated rotation is enabled and mutual movement in the axial direction is also enabled. In addition, the bearing portion 28 may be biased from the support frame 100 upwards through a non-illustrated biasing member.

Figure 5A:
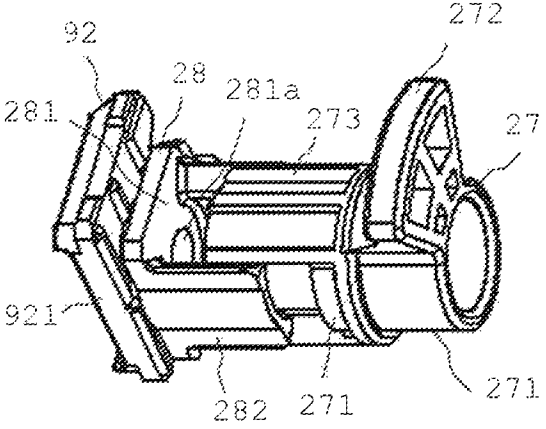
FIG. 5A is a partial perspective view of a left edge portion of the meandering correction mechanism.
Figure 5B:
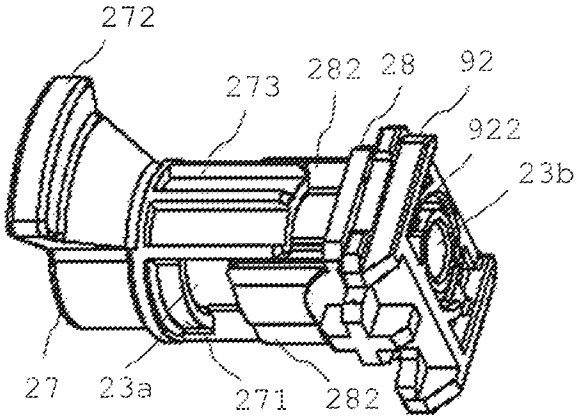
FIG. 5B is a partial perspective view of a right edge portion of the meandering correction mechanism.
Figure 5C:
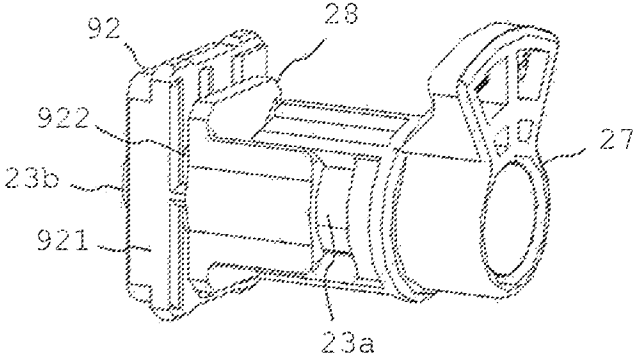
FIG. 5C is a partial perspective view illustrating a bearing support portion of the meandering correction mechanism.

The bearing support portion 92 has a plate-like portion 921 supported by the support frame 100 and, as illustrated in particular in FIG. 5B and FIG. 5C, is provided with a relatively long hole 922 in the vertical direction in the center of the plate-like portion 921. The long hole 922 is inserted by the shaft 23*a* and also has a dimension corresponding to the inclination range in the vertical direction of the shaft 23*a* accompanying the meandering of the intermediate transfer belt 21. The end portion of the shaft 23*a* includes a publicly known falling-off prevention structure 23*b* mainly using a C ring, the falling-off prevention structure restricting the shaft 23*a* from falling off from the long hole 922 of the bearing support portion 92.

The inclination guide portion 91 is fixedly installed in the support frame 100. The inclination guide portion 91 is arranged outward in the radial direction of the shaft 23*a* with respect to the contact portion 272 of the meandering correction collar member 27. On the lower surface of the inclination guide portion 91, a horizontal surface 911 parallel to the axial direction when the meandering does not occurs and an inclined surface 912 are formed continuously from the center side in the axial direction of the shaft 23*a*. The inclined surface 912 is formed to have a predetermined angle from the horizontal surface 911 toward obliquely downward (so as to gradually approach to the shaft 23*a* in a case in which there is no meandering).

The inclination guide portion 91, in a state in which meandering does not occur in the intermediate transfer belt 21, is set to be positioned so that the contact portion 272 of the meandering correction collar member 27 may contact the horizontal surface 911. Then, when the intermediate transfer belt 21 meanders and then causes the tension collar member 25 to move toward the end side of the shaft 23*a*, the meandering correction collar member 27 also moves and the contact portion 272 is made to contact from the horizontal surface 911 to the inclined surface 912. As a result, the shaft 23*a* comes to incline downward, and, in response to such an inclination, the intermediate transfer belt 21 may return to the central side in the axial direction of the shaft 23*a* and thus the control of correcting meandering is performed. It is to be noted that the end face of the annular portion 271 of the meandering correction collar member 27 contacts the end face of the engaging portion 282 of the bearing portion 28, which restricts the meandering of the intermediate transfer belt 21 from further occurring. In the present preferred embodiment, since the meandering correction collar member 27, while the rotation of the meandering correction collar member 27 is restricted, contacts the inclination guide portion 91, and, as compared with the case in which the meandering correction collar member 27 is integrally rotated with the meandering correction roller 23, has no influence of friction in the rotational direction, which enables the meandering correction collar member 27 to smoothly move in the axial direction.

It is to be noted that, while the meandering correction collar member 27 and the inclination guide portion 91 are made to contact each other in the present preferred embodiment, as a second preferred embodiment, the slide sheet 26 and the meandering correction collar member 27 may be omitted and an annular projection may be additionally provided outside in the axial direction of the collar portion 252 of the tension collar member 25 to be a contact portion.

In addition, while the horizontal surface 911 and the inclined surface 912 that are provided in the inclination guide portion 91 are made into a discontinuous surface, as a third preferred embodiment, the horizontal surface 911 and the inclined surface 912 may be formed smoothly continuously and the inclined surface 912 may be a curved surface in addition to a flat surface.

Moreover, in the present preferred embodiment, while the meandering correction roller 23 and the shaft 23*a* are configured to rotate integrally, a configuration in which the meandering correction roller 23 and the shaft 23*a* spin integrally through a bearing (shaft bearing) and the like may be employed. Further, a roller provided with such a meandering correction mechanism may not be limited to the meandering correction roller 23, but may be the tension roller 231, or other rollers that have a certain amount of a contact area with the intermediate transfer belt 21.

In addition, while the intermediate transfer portion 20 is illustrated as a mechanism portion that causes the belt to rotate and drive in the present preferred embodiment, the present invention is not limited to such a structure but is applicable to the secondary transfer portion 30 using an endless belt, the fixing portion 40 that performs conveyance using the endless belt, the paper sheet feed path 60, and the automatic document feeder 80.

The foregoing preferred embodiments are illustrative in all points and should not be construed to limit the present invention. The scope of the present invention is defined not by the foregoing preferred embodiment but by the following claims. Further, the scope of the present invention is intended to include all modifications within the scopes of the claims and within the meanings and scopes of equivalents.

What is claimed is:

1. A belt rotating device comprising:

a meandering correction roller that is rotatably supported within a support frame and is one of a plurality of rollers that stretch an endless belt;

a supporting portion that is provided at the support frame and supports a rotating shaft of the meandering correction roller so as to be able to incline the rotating shaft of the meandering correction roller in a one direction;

a collar member that is provided on the rotating shaft of the meandering correction roller, contacts an end of the endless belt in which meandering has occurred, and moves in an axial direction; and a contact member that is supported by the support frame and has an inclined surface oriented in the one direction and inclined with respect to the rotating shaft, in a position in which a portion of the collar member contacts the contact member.

2. The belt rotating device according to claim 1, wherein:

the collar member includes a first collar member and a second collar member that are arranged adjacent to each other on the rotating shaft; and the first collar member contacts the endless belt;

the second collar member contacts the contact member and is restricted from rotating with respect to the rotating shaft.

3. The belt rotating device according to claim 2, wherein a low friction member is inserted between the first collar member and the second collar member.

4. The belt rotating device according to claim 1, wherein:

the contact member has a horizontal surface on an upper portion of the inclined surface; and the collar member contacts the horizontal surface without meandering.

5. The belt rotating device according to claim 1, wherein at least one of the collar member and the contact member includes a restricting portion that restricts a movement range of the collar member.

6. The belt rotating device according to claim 1, wherein the meandering correction roller and the rotating shaft rotate integrally.

7. A transfer device comprising the belt rotating device according to claim 1, wherein the endless belt is a transfer belt onto which a toner image is transferred.

8. An image forming apparatus comprising the transfer device according to claim 7.

* * * * *